United States Patent [19]

LeFrois

[11] 4,443,180

[45] Apr. 17, 1984

[54] VARIABLE FIRING RATE OIL BURNER USING AERATION THROTTLING

[75] Inventor: Richard T. LeFrois, Minneapolis, Minn.

[73] Assignee: Honeywell Inc., Minneapolis, Minn.

[21] Appl. No.: 262,150

[22] Filed: May 11, 1981

[51] Int. Cl.[3] ..... F23N 1/00

[52] U.S. Cl. ..... 431/4; 431/11; 431/211; 431/240; 431/242; 431/37

[58] Field of Search ..... 431/11, 2, 37, 211, 431/240, 242, 12; 123/545, 555, 556

[56] References Cited

U.S. PATENT DOCUMENTS

| | | | |
|---|---|---|---|
| 1,403,954 | 1/1922 | Herpin | 431/211 |
| 1,542,583 | 6/1925 | Roberts | 431/211 |
| 2,396,577 | 3/1946 | Kittel et al. | 431/240 |
| 2,852,308 | 9/1958 | Whitson | 299/107.2 |
| 3,561,895 | 2/1971 | Michelson | 431/11 |
| 4,189,914 | 2/1980 | Marek et al. | 431/2 |
| 4,195,779 | 4/1980 | Auclair et al. | 239/8 |
| 4,255,114 | 3/1981 | Aerne | 431/2 |

OTHER PUBLICATIONS

"Study of a Thermal Aerosol Oil Burner", J. E. Janssen, J. J. Glatzel, E. R. Wabasha, and U. Bonne, EPA-600-/7-77-108, Sep. 1977.

*Primary Examiner*—Carroll B. Dority, Jr.
*Attorney, Agent, or Firm*—Charles G. Mersereau

[57] ABSTRACT

A pressure atomizing liquid fuel burner having an improved turndown ratio is disclosed along with a method of increasing the turndown ratio in such burners. The burner includes means for adding an amount of gas to the liquid fuel prior to the injection of the fuel which causes the liquid fuel to foam such that a liquid-gas foamed mixture is injected. The relative amounts of the aeration gas and the liquid fuel are controlled such that the injection velocity is maintained relatively constant over a wide turndown ratio in the liquid fuel. The aeration gas to be added to the liquid fuel may be preheated prior to the addition of the gas to the liquid fuel.

7 Claims, 6 Drawing Figures

VARIABLE FIRING RATE OIL BURNER USING AERATION THROTTLING

BACKGROUND OF THE INVENTION

1. Field of the Invention

The present invention relates generally to the field of pressure atomizing liquid fueled burners and, more particularly, to a method and apparatus for increasing the turndown capability of oil pressure atomizing burners using aeration throttling.

2. Description of the Prior Art

Oil pressure atomizing burners, also known as mechanical pressure atomizing burners, operate on the principle that when oil under pressure is permitted to expand through a small orifice it tends to break into a spray of very fine droplets which are suitable for combustion. These burners are usually designed to operate with oil pressures as high as 75 to 100 psi and viscosities of from less than 50 to 100 SSU. The principle upon which these burners operate requires that the pressure drop across the atomizing orifice be maintained high and as nearly constant as possible in order to achieve the necessary spray of fine atomized droplets. Because it is not possible to maintain the required pressure drop at lower flows, turndown, which is defined as the ratio of maximum to minimum input rates, in the operation of such burners has traditionally been very severely limited or has not been used at all and the burners have been operated in an on-off mode only. This, of course, results in inferior temperature control and lower furnace efficiency.

It has been found that improved atomization, i.e. smaller droplet size also permits better mixing of the air and the fuel and reduces the tendency to form soot. Atomization can be improved by increasing the internal energy of the fuel as by preheating the fuel. One such study and analysis which demonstrates the benefits of maximizing the internal energy of the fuel per unit volume and minimizing the apparent viscosity for atomization prior to combustion is found in *Study of a Thermal Aerosol Oil Burner*, by J. E. Janssen, J. J. Glatzel, E. R. Wabasha and V. Bonne, published in EPA Report 600/7-77-108, September, 1977.

Inasmuch as the cost of oil and other liquid fuels has increased greatly in the last few years, concern with more efficient fuel utilization in oil burners has also become much greater. Thus, there has existed a need to have a great deal more control over the fuel consumption of a burner while maintaining the best combustion efficiency possible for that burner at all possible flows. Thus, there has existed a need for accomplishing more effective burner turndown while maintaining an even increasing combustion efficiency in pressure atomizing liquid fuel burners.

SUMMARY OF THE INVENTION

By means of the present invention the problems associated with the inability to turn down oil pressure atomizing burners has been solved by the provision of an aeration throttling system which maintains the necessary reasonably high velocity at the orifice or injector while allowing the oil burner to enjoy a relatively high turndown ratio. This is accomplished by adding an aeration gas to the liquid fuel prior to atomization which reduces the effective density of the fuel by creating a foamed mixture. The pressurized gas added to the mixture may be preheated to increase combustion efficiency as by utilizing heat from the burner combustion itself. A throttling or turndown ratio in excess of 10 to 1 can be achievied with less than a 1% by weight gas addition to the fuel. Thus by adding either a reactive or non-reactive gas to the liquid fuel stream in the oil burner, a foamed mixture can be produced whose density is highly controllable, and this control may be utilized to modulate the fuel input to the burner over a wide range.

The foam generator/preheater may consist of a tubular barrel containing integral metallic mesh which provides a large surface area per unit volume. Preheating is provided by a heating coil which allows the aeration gas and mecahanical structure to reclaim heat from the combustion zone and transfer this heat to the incoming oil or liquid fuel. The heating coil in the form of a length of hollow tube connected at one end to a supply of the aeration gas extends through a preheating section in the combustion chamber and is connected at the other end to the foam generator. The aeration gas flows on the inside of the tube and heat from the combustion zone is transferred to the gas. Warmed gas enters the generator at the base and foams the entering liquid fuel.

Throttling of the fule may be accomplished by controlling the flow from the fuel metering pump as by a bypass system or by modulating the pump motor speed in a well known manner. This is done in conjunction with modulation of the aeration gas using a temperature compensated flow ratio controller or similar device. Any number of standard design schemes can be used to provide for integrated control of electric ignition, flame safeguard, coordinating aeration gas flow with the modulating flow, fuel preheat and gas heat content.

BRIEF DESCRIPTION OF THE DRAWINGS

In the drawings, wherein numerals are utilized to depict like parts throughout the same:

FIG. 1(*a*) is a front end view of the burner of FIG. 1;

FIG. 1(*b*) is a rear end view of the burner of FIG. 1;

FIG. 1(*c*) is a detail of the main air inlet of the burner of FIG. 1;

FIG. 1(*d*) is an enlarged detail of the foaming unit of FIG. 1; and

DESCRIPTION OF THE PREFERRED EMBODIMENT

Figure 1:
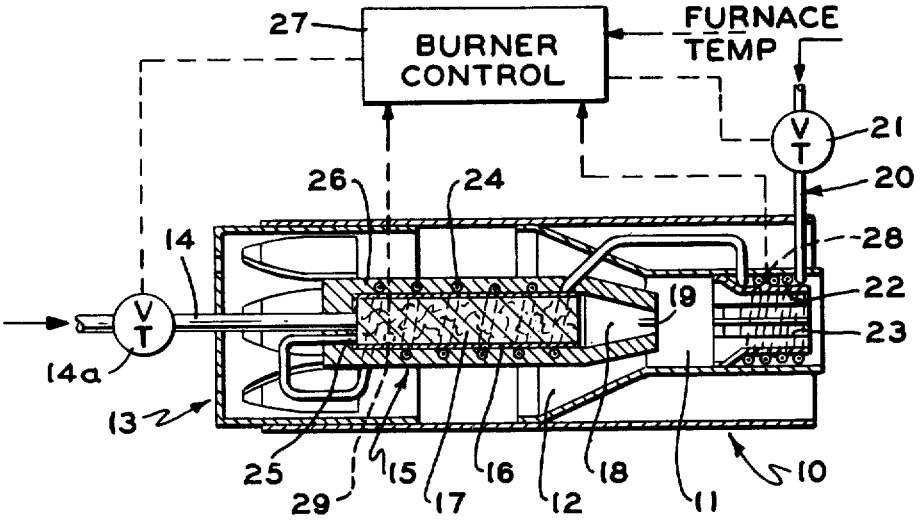
FIG. 1 is a view partially in section of a typical oil burner utilizing the invention.
Figure 1A:
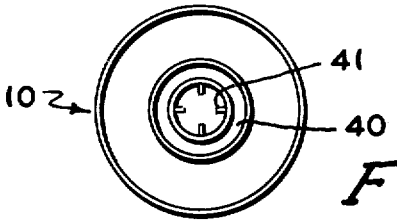
Figure 1B:
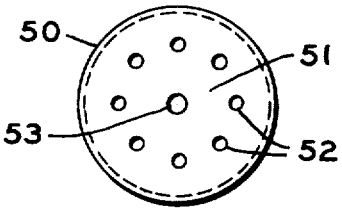
Figure 1C:
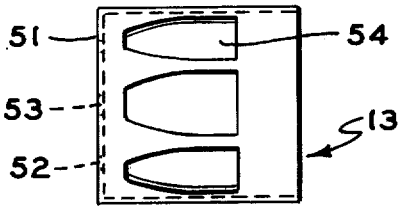

In FIG. 1 there is shown a cross sectional view of a typical oil burner equipped with the aeration throttling system of the invention. The burner includes a main outer shell 10, combustion chamber 11, main combustion air inlet register 12, adjustable air inlet damper system 13 (shown in greater detail in FIGS. 1(*b*) and 1(*c*), fuel inlet conduit 14, containing throttling valve 14*a* and aeration foam module or generator/preheater 15. The aeration foam generator/preheater 15 preferrably consists of a tubular barrel 16 containing a unitized fine metallic mesh 17 such as Open Celled Metal Foam available from Rocket Research Corporation of Redmond, Washington, which provides a very large surface area per unit volume. The metallic mesh also provides a uniform heat transer area for preheating the fuel. Attached to the generator preheater 15 is the atomizer or injector 18 having at least one small orifice 19 therein. An auxiliary or aeration gas supply tube 20 with throttling valve 21 is provided including a first coil section 22 which winds about the nozzle section 23 of the combustion chamber 11 and a second coil section 24 which winds about the shell 16 of the foam generator/preheater 15 and connects to the generator/preheater chamber at 25. The generator/preheater is suitably insulated as at 26.

A typical control unit is shown in block form at 27 which may receive temperature signals from sensor 28 and generator/preheater temperature and pressure signals from other sensing devices as at 29 and furnace chamber temperature signals from yet another sensor not shown. The central unit, in turn, controls the fuel flow as by the fuel flow modulating device or throttling valve 14*a* and controls the auxiliary aeration gas flow as by flow throttling valve 21.

As can better be seen in FIG. 1(*a*), the combustion chamber nozzle section 23 contains a ring 40 having a series of directional fins 41 therein. This system aids in the transfer of heat to the coil section 22 to preheat the auxiliary or aeration gas.

FIGS. 1(*b*) and 1(*c*) show the air modulating insert section 13 in greater detail. Thus, the end elevational view of FIG. 1(*b*) includes a cyclindrical shell 50 having an end section 51 with minimum air supply holes 52 along with an opening for the fuel pipe at 53. As seen in FIG. 1(*c*) there are a series of radially space elongated openings 54 which can be utilized to set or adjust the amount of primary air which enters the internal burner chamber. Thus, it can be seen from FIG. 1 that the rear insert section 13 is movable within the burner shell 10 to adjust the relative size of the air inlet openings 54 through which outside air can enter. While this adjustment is normally made at the time of installation, the system can, if desired, be controlled continuously in conjunction with the burner firing rate.

Figure 1D:
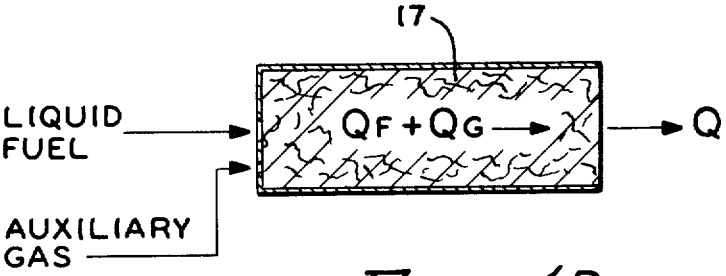

The foam generator/preheater 15 is shown with volumetric flow symbols in FIG. 1D. A discussion of the burner flow in regard to the present invention follows. As previously discussed, pressure type atomizing burners typically required a $\Delta P$ across the atomizing nozzle which may be as much as 75 to 100 psi to properly atomize the fuel for combustion. For proper atomization it is necessary that a reasonably high velocity be maintained through the orifice or injector of the burner. This velocity may be expressed as:

$$U_f = \frac{W_f}{\rho_f A} \text{ for the fuel} \tag{1}$$

$$U_g = \frac{W_g}{\rho_g A} \text{ for the aeration gas} \tag{1a}$$

$$U = \frac{W}{\rho A} \text{ for a combination of the two} \tag{1b}$$

where $U_f$=orifice velocity of the fuel
$U_q$=orifice velocity of the aeration gas
U=orifice velocity of the combination of gas and fuel
$W_f$=liquid fuel flow (weight)
$W_g$=aeration gas flow (weight)
W=combined flow (weight)
$\rho_f$=liquid fuel density
$\rho_g$=aeration gas density
$\rho$=combined effective bulk density
A=orifice area It can readily be seen from equation 1 that when $W_f$ is reduced, the $U_f$ reduces accordingly and the ability to efficiently atomize the liquid fuel rapidly decreases. Thus, if the allowable range of fuel pressure for the burner is between 100 and 75 psi, for example, the liquid fuel which, of course, is also directly related to the nozzle pressure flow can be reduced only by 25% from the maximum without causing instability in the burner system. This, of course, results in a very limited operating turndown ability.

On the other hand, in accordance with the present invention, when a small amount of gas ($W_g$) is injected into the liquid stream with fuel flow ($W_f$) the effective bulk density ($\rho$) of the combination is significantly reduced and the resulting injection velocity U, as given in equation (1b) can be caused to remain esentially constant by controlling the relative amounts of $W_f$ and $W_g$. This can be shown as follows:

If the total volumetric flow from the aeration chamber be Q and that of the liquid fuel and auxiliary gas be $Q_f$ and $Q_g$, respectively, as shown on FIG. 1D, then we have $$Q = Q_f + Q_g \tag{2}$$

Using the homogeneous two component flow model approach, pseudo properties can be derived by suitably weighting the properties of the individual components, thus let $$Q_f = \frac{W_f}{\rho_f} = \frac{W(1-x)}{\rho_f} \tag{3}$$

where (1−x)=Weight fraction of liquid fuel in the aerosol thus:

$$(1-x) = \frac{W_f}{W_g + W_f} = \frac{W_f}{W} \tag{4}$$

let $$Q_g = \frac{W_g}{\rho_g} = \frac{Wx}{\rho_g} \tag{5}$$

where x=Weight fraction of auxiliary gas in the aerosol thus:

$$x = \frac{W_g}{W_g + W_f} = \frac{W_g}{W} \tag{6}$$

by letting $$Q = W/\rho \tag{7}$$

and substituting equations (3) (5) and (7) into (2) we get $$\frac{W}{\rho} = \frac{W(1-x)}{\rho_f} + \frac{Wx}{\rho_g} \tag{8}$$

Solving equation (8) for the combined effective bulk density ($\rho$) gives $$\rho = \frac{\rho_f}{1 + x\left(\frac{\rho_f}{\rho_g}\right)} \quad (9)$$

The necessary conditions required to assure bubbly to foam patterns are based on the Baker horizontal flow pattern map. This can be found in Baker, O., *Design of Pipelines for Simultaneous Flow of Oil and Gas.* Oil and Gas Journal 26, July (1954). This flow pattern map has become generally accepted and widely used. It can be shown that bubbly to foam flow will exist when $$\frac{W_f}{A_f} \cdot \Psi \geqq 750 \quad (10)$$

and $$\frac{W_g}{A_g} / \lambda \leqq 20 \quad (11)$$

where $A_f$=cross sectional area portion containing liquid $A_g$=cross sectional area portion containing gas $\Psi$=dimensionless physical property parameter containing surface tension, viscosity and density ratio products $\lambda$=dimensionless physical property parameter containing reference density ratio products This corresponds to gas weight fraction (x) limits of approximately $0<x<0.2$ The gas density ($\rho_g$) will vary depending upon the injection pressure and temperature and for low pressures and high temperatures the density variation can be expressed as:

$$\rho_g = P/RT \quad (12)$$

where

P=pressure (psia)

R=specific gas constant

T=absolute temperature (°R)

Figure 2:
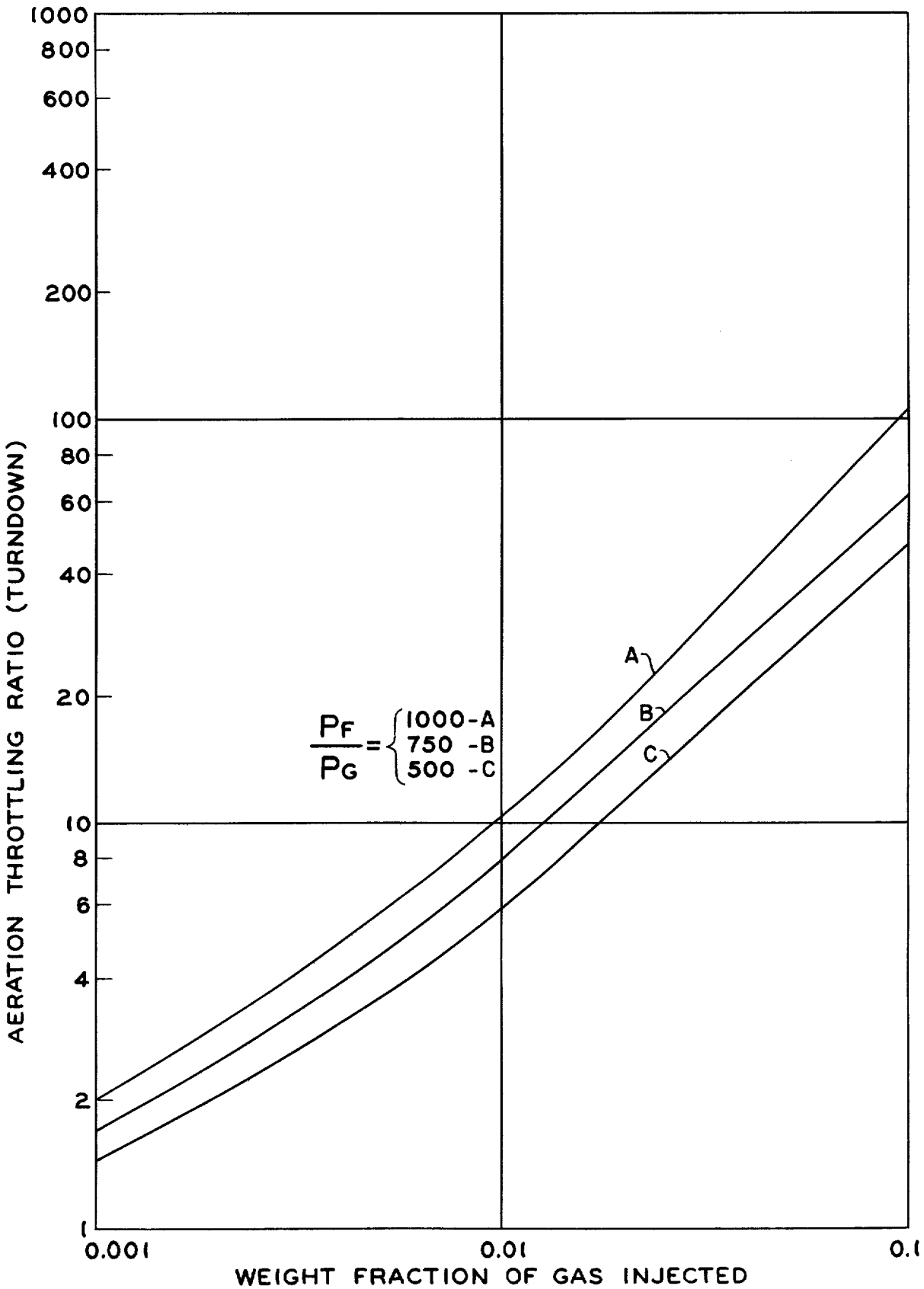
FIG. 2 is a graph representing the aeration throttling ratio of a burner in accordance with the invention versus the weight fraction of gas injected into the foaming unit for a range of achievable liquid fuel to gas density ratios.

As indicated by Equations (9) and (10), as a greater quantity or higher temperature gas is added to the liquid, the effective density ($\rho$) of the foamed mixture is reduced. However, increasing pressure tends to have the opposite effect. FIG. 2 shows a graphical representation of the possible aeration throttling ratio versus the weight fraction of gas injected into the mixture for acceptable weight fractions for foam to bubbly flow. As can be seen from that graph as little as 0.01 weight fraction of gas injected results in an aeration throttling ratio of more than 10 to 1 and as little as 0.1 or a 10% weight fraction yields a turndown or aeration throttling ratio in excess of 100 to 1. Of course this ratio will vary with the relative densities of the fuel and gas being used, the injection pressure and preheat temperature. The 500 to 1 represents a typical weight ratio between the density of compressed air at 300° F. and No. 2 furnace oil at 18 psig.

It can be seen from the above that the firing rate of the burner can readily be adjusted (turned down) by varying the amount of the aerating gas which is fed into the burner system. This allows the relatively high required injection velocity to be maintained over a wide turndown range. This also results in a high combustion efficiency.

The burner system in accordance with the present invention can be operated with either a reactive gas, i.e. one which reacts with the liquid fuel to be burned such as air or oxygen or a non-reactive gas, i.e., one which remains inert during the combustion reaction such as nitrogen, helium, argon and the like. In addition, fuel gas such as natural gas could be supplied in this manner which would also provide a high input capability to the burner.

In operation, the burner is started up by partially opening valve 14a and starting the fuel flowing to the foam generator 15. At the same time the flow of the auxiliary gas is begun to the tube 20 by partially opening valve 21. The atomized fuel is then ignited in the combustion chamber 11. The gas in the tube 20 begins to be preheated in the heating coil section 22 which surrounds the combustion chamber and therafter flows on to preheat the foam generator/preheater in section 24. The gas injected into the foam generator which becomes part of the aerated mixture gradually comes up to the desired temperature. In this manner heat from the combustion zone is used to preheat the fuel in the aeration chamber 18. The injection of the gas into the tubular barrel containing the metallic mesh 17 provides a very large surface area per unit volume for the fuel which causes fuel to foam a great deal prior to its atomization through the injector nozzle orifice 19. The control system of the invention may consist of conventional analog responsive devices or a microprocessor based control unit containing a specific program which is self-contained as firmware in a microprocessor chip. The function of the control system is to respond to an input command to modulate the burner heat input rate using the sensor temperature and pressure and flow inputs from the device and the furnace.

The microprocessor controlled system central program in the central processing unit can compute an appropriate set of output control signals to the gas and fuel flow control valves thereby modulating the valve settings as required. The firmware may contain the necessary bias, gain, offset and limit instructions to maintain the proper gas to liquid flow ratio for foam generation, correct for gas temperature and pressure variations, liquid fuel heat content and assure safe startup and shutdown of the burner. The stored firmware may also contain unique calibration constants resulting from tailoring control package to the specific burner device.

Similarly an analog system can be made to respond to changes in conditions to modulate the valves 14a and 21 in a well known fashion. The preferred control system depends to a great extent upon the particular burner application involved.

Thus, the system of the present invention provides a novel method and apparatus for aeration throttling of conventional atomizing oil burners allowing such burners to be useful and efficient over a wide turndown range which was formerly not possible.

The embodiments of the invention in which as exclusive property or right is claimed are defined as follows:

1. A method for increasing the turndown ratio in a pressure atomizing liquid fuel burner comprising the steps of:

combining an amount of auxiliary gas with the liquid fuel prior to the atomization thereof in a generator/preheater in a manner which produces a substantially homogeneous foam;

atomizing said foam into a combustion chamber through a pressure-atomizing means; and modulating the fuel consumption of the burner in response to temperature and pressure in said generator/preheater by controlling the auxiliary gas weight fraction in said foam such that the atomization pressure to said pressure-atomizing means remains substantially constant throughout the full turndown range of said burner.

2. The method of claim 1 wherein the auxiliary gas weight fraction is between 0.0 and 0.2.

3. The method of either of claims 1 or 2 wherein said fuel is oil.

4. A pressure-atomizing liquid fuel burner comprising:

a source of combustion air;

a source of liquid fuel;

a source of auxiliary gas;

chamber means for combining said liquid fuel and said auxiliary gas prior to the atomization thereof in a manner such that a substantially homogeneous foam is created;

pressure atomizing means for atomizing said foamed mixture;

combustion chamber for burning said atomized fuel; and control means responsive to temperature and pressure in said chamber means for modulating the auxiliary gas wieght fraction in said foam such that the atomization pressure of said pressure-atomizing means remains substantially constant throughout the full turndown range of said burner.

5. The apparatus according to claim 4 wherein the auxiliary gas weight fraction is between 0.0 and 0.2.

6. The apparatus of either of claims 4 or 5 wherein said chamber means for combining said fuel and said auxiliary gas comprises a closed chamber connected with said pressure atomizing means, said chamber being filled with means to provide a large surface area per unit volume therein.

7. The apparatus of claim 6 wherein said means for providing said large surface area per unit volume in said chamber is a metallic mesh.

* * * * *